US010907565B2

(12) United States Patent
Girard et al.

(10) Patent No.: US 10,907,565 B2
(45) Date of Patent: Feb. 2, 2021

(54) METHOD FOR CONTROLLING A DIGITAL HIGH-PRESSURE PUMP

(71) Applicants: Continental Automotive France, Toulouse (FR); Continental Automotive GmbH, Hannover (DE)

(72) Inventors: Nicolas Girard, Carbonne (FR); Tet Kong Brian Chia, Regensburg (DE)

(73) Assignees: Continental Automotive France; Continental Automotive GmbH

( * ) Notice: Subject to any disclaimer, the term of this patent is extended or adjusted under 35 U.S.C. 154(b) by 0 days.

(21) Appl. No.: 16/609,347

(22) PCT Filed: Jun. 28, 2018

(86) PCT No.: PCT/FR2018/051590
§ 371 (c)(1),
(2) Date: Oct. 29, 2019

(87) PCT Pub. No.: WO2019/002776
PCT Pub. Date: Jan. 3, 2019

(65) Prior Publication Data

US 2020/0056561 A1 Feb. 20, 2020

(30) Foreign Application Priority Data

Jun. 30, 2017 (FR) ..... 17 56140

(51) Int. Cl.
*F02D 41/00* (2006.01)
*F02D 41/30* (2006.01)
(Continued)

(52) U.S. Cl.
CPC ..... *F02D 41/3082* (2013.01); *F02D 41/062* (2013.01); *F02D 41/22* (2013.01);
(Continued)

(58) Field of Classification Search
CPC ..... F02D 41/3082; F02D 41/3845; F02D 41/062; F02D 41/22; F02D 2041/226;
(Continued)

(56) References Cited

U.S. PATENT DOCUMENTS 5,893,352 A 4/1999 Fujiwara
2007/0169752 A1* 7/2007 Snopko ..... F02D 41/3845 123/467

(Continued)

FOREIGN PATENT DOCUMENTS

DE 102010027675 A1 1/2012
DE 102012210087 A1 12/2013
FR 3043141 A1 5/2017

OTHER PUBLICATIONS

International Search Report and Written Opinion for International Application No. PCT/FR2018/051590, dated Dec. 4, 2018—11 pages.

*Primary Examiner* — Phutthiwat Wongwian
*Assistant Examiner* — Sherman D Manley
(74) *Attorney, Agent, or Firm* — RatnerPrestia

(57) ABSTRACT

A method for controlling a digital high-pressure pump, the control method including the following consecutive steps when the internal combustion engine does not manage to start during the starting procedure: checking the external parameters of the internal combustion engine; measuring a physical parameter at the high-pressure output, applying an electrical detachment control signal as a replacement for the electrical control signal to the high-pressure pump during the starting procedure when the physical parameter measured at the high-pressure output is less than or equal to a reference value, and stopping the starting procedure after a given time when the physical parameter measured at the high-pressure output is greater than the reference value.

12 Claims, 4 Drawing Sheets

(51) Int. Cl.

| | |
|---|---|
| ***F02D 41/06*** | (2006.01) |
| ***F02D 41/22*** | (2006.01) |
| ***F02D 41/38*** | (2006.01) |
| ***F02M 59/02*** | (2006.01) |
| ***F02M 59/36*** | (2006.01) |
| ***F02M 63/02*** | (2006.01) |

(52) U.S. Cl.
CPC ..... *F02D 41/3845* (2013.01); *F02M 59/025* (2013.01); *F02M 59/366* (2013.01); *F02M 63/023* (2013.01); *F02D 2041/226* (2013.01); *F02D 2200/06* (2013.01)

(58) Field of Classification Search
CPC ..... F02D 2200/06; F02M 59/025; F02M 59/366; F02M 63/023; F02M 63/0225
See application file for complete search history.

(56) References Cited

U.S. PATENT DOCUMENTS

| | | | | |
|---|---|---|---|---|
| 2008/0294327 | A1* | 11/2008 | Oono ..... | F02D 41/3845 701/104 |
| 2019/0063362 | A1 | 2/2019 | Agnus et al. | |
| 2019/0309700 | A1* | 10/2019 | Chia ..... | F02D 41/3845 |
| 2019/0317008 | A1* | 10/2019 | Schuda ..... | G01N 15/1404 |

* cited by examiner

METHOD FOR CONTROLLING A DIGITAL HIGH-PRESSURE PUMP

CROSS REFERENCE TO RELATED APPLICATIONS

This application is the U.S. National Phase Application of PCT International Application No. PCT/EP2018/051590, filed Jun. 28, 2018, which claims priority to French Patent Application No. 1756140, filed Jun. 30, 2017, the contents of such applications being incorporated by reference herein.

FIELD OF THE INVENTION

The present invention pertains in general to a method for controlling a high-pressure pump dedicated for example to dispensing fuel into an internal combustion engine.

It relates more particularly to what is known as an "anti-attachment" control method for a high-pressure pump in order to attempt to eliminate at least one particle that may prevent the correct operation of said high-pressure pump.

The invention is applicable in particular in the automotive industry. It may be implemented, for example, in an engine control computer.

BACKGROUND OF THE INVENTION

An increasing number of motor vehicles are equipped with injection means for supplying fuel to the internal combustion engine. There are various types of injection, such as for example direct injection or common rail injection.

For more than a decade, common rail technology has been increasingly used to directly or indirectly inject fuel into cylinders of an internal combustion engine. The principle of this technology is based on the use of a first low-pressure pump designed to take in fuel from a tank and deliver it at a low pressure, for example 5 bar, to the input of a second high-pressure pump. The second high-pressure pump is for its part designed to supply fuel at a pressure of the order for example of 2000 bar to the common rail of the internal combustion engine.

The common rail is designed to supply injectors of the internal combustion engine. By virtue inter alia of the second high-pressure pump and the use of injectors, such as for example piezoelectric injectors, it is possible to control the amount of fuel that is injected with great precision.

In a simplified and general manner, the second high-pressure pump includes at least a pump body, a low-pressure fuel input, a high-pressure fuel output, a chamber designed to receive a piston and a valve allowing the fuel to flow or not to flow into the chamber. The piston is able to move between a first bottom position, allowing the chamber to be filled, and a second top position that makes it possible, by the piston rising in the chamber so as to interact with the closure of the valve, to inject the fuel into the common rail under pressure.

The presence of particles in the fuel may prevent the valve from being closed and therefore prevent the pressure of the fuel from rising.

Various high-pressure pump technologies exist. If the second high-pressure pump is what is known as an analog high-pressure pump, this is generally controlled using a first PWM, from the acronym pulse width modulation, control signal. Thus, by varying the duty cycle of the PWM signal, it is possible to control the opening of the valve of said high-pressure pump and thus firstly to control the pressure in the rail, and secondly, if a particle is trapped, to try to eliminate it.

If the second high-pressure pump is what is known as a "digital" pump, it is not possible to control it with a PWM control signal. As is known to those skilled in the art, this type of high-pressure pump is controlled with a peak and hold control signal. The peak and hold control signal has to be applied synchronously with an engine cycle so as to allow a sufficient pressure rise in the rail. However, if a particle is trapped in the valve, it is difficult to dislodge it with a peak and hold control signal.

SUMMARY OF THE INVENTION

The aim of an aspect of the present invention is then to provide a method for controlling a high-pressure pump in order to try to dislodge a particle preventing correct operation of said high-pressure pump.

To this end, an aspect of the present invention proposes a method for controlling a digital high-pressure pump including a low-pressure input designed to receive a fuel, a high-pressure output designed to deliver pressurized fuel, at least one chamber designed to receive a piston, the piston being able to move and allowing the fuel in the high-pressure pump to be pressurized toward its high-pressure output, a valve including a valve head, the valve being designed to move from a first position to a second position, the second position making it possible to keep the fuel pressurized in order to be delivered into a common rail through its high-pressure output, the high-pressure pump furthermore being designed to be controlled using an electrical control signal, the high-pressure pump being activated inter alia during a starting procedure of an internal combustion engine, the control method including the following consecutive steps when the internal combustion engine does not manage to start during the starting procedure:

- checking the external parameters of the internal combustion engine;
- measuring a physical parameter at the high-pressure output,
- applying an electrical detachment control signal SD as a replacement for the electrical control signal to the high-pressure pump during the starting procedure when the physical parameter measured at the high-pressure output is less than or equal to a reference value,
- stopping the starting procedure after a given time when the physical parameter measured at the high-pressure output is greater than the reference value.

Thus, with such control, it is possible, while the fuel is being drawn in and discharged by the high-pressure pump, to move the piston in the cylinder in order to try to dislodge the blocked particle.

Before applying the electrical detachment control signal, the method of an aspect of the invention proposes, in one exemplary embodiment, a step in which external parameters of the internal combustion engine are checked, which include(s) ? a check of the fuel level in a tank. It is thus possible to see whether the non-starting of the internal combustion engine is actually linked to a problem with the high-pressure pump.

For example, the method includes a step of checking the control means of the high-pressure pump.

For the sake of electronic optimization, it is proposed for example for the electrical detachment control signal to be formed of an elementary electrical signal that is duplicated n times. The memory space that is allocated is thus smaller.

To allow time for the valve to move perfectly, it is proposed for example for the elementary electrical signal to include a first elementary phase, a second elementary phase and lastly a third elementary phase, the first elementary phase varying between a first minimum amplitude value and a first maximum amplitude value, the second elementary phase varying between the first maximum value and a freewheeling value, the third elementary phase varying between the first freewheeling value and the first minimum amplitude value.

To increase the chances of dislodging the trapped particle, it is expediently proposed for the electrical detachment control signal to be applied to the high-pressure pump during at least one fuel intake phase.

In order for the particle to be evacuated more quickly, it is proposed for example for the electrical detachment control signal to be applied to the high-pressure pump during at least one fuel delivery phase.

To be compatible both with various high-pressure pumps but also various control electronics of said high-pressure pump, it is proposed for example for the elementary electrical signal to have a modifiable duration.

In one exemplary embodiment, it is proposed for the elementary electrical signal to be a pick and hold signal.

BRIEF DESCRIPTION OF THE DRAWINGS

Details and advantages of aspects of the present invention will become more clearly apparent from the following description, given with reference to the appended schematic drawing, in which.

DETAILED DESCRIPTION OF THE PREFERRED EMBODIMENTS

Figure 1:
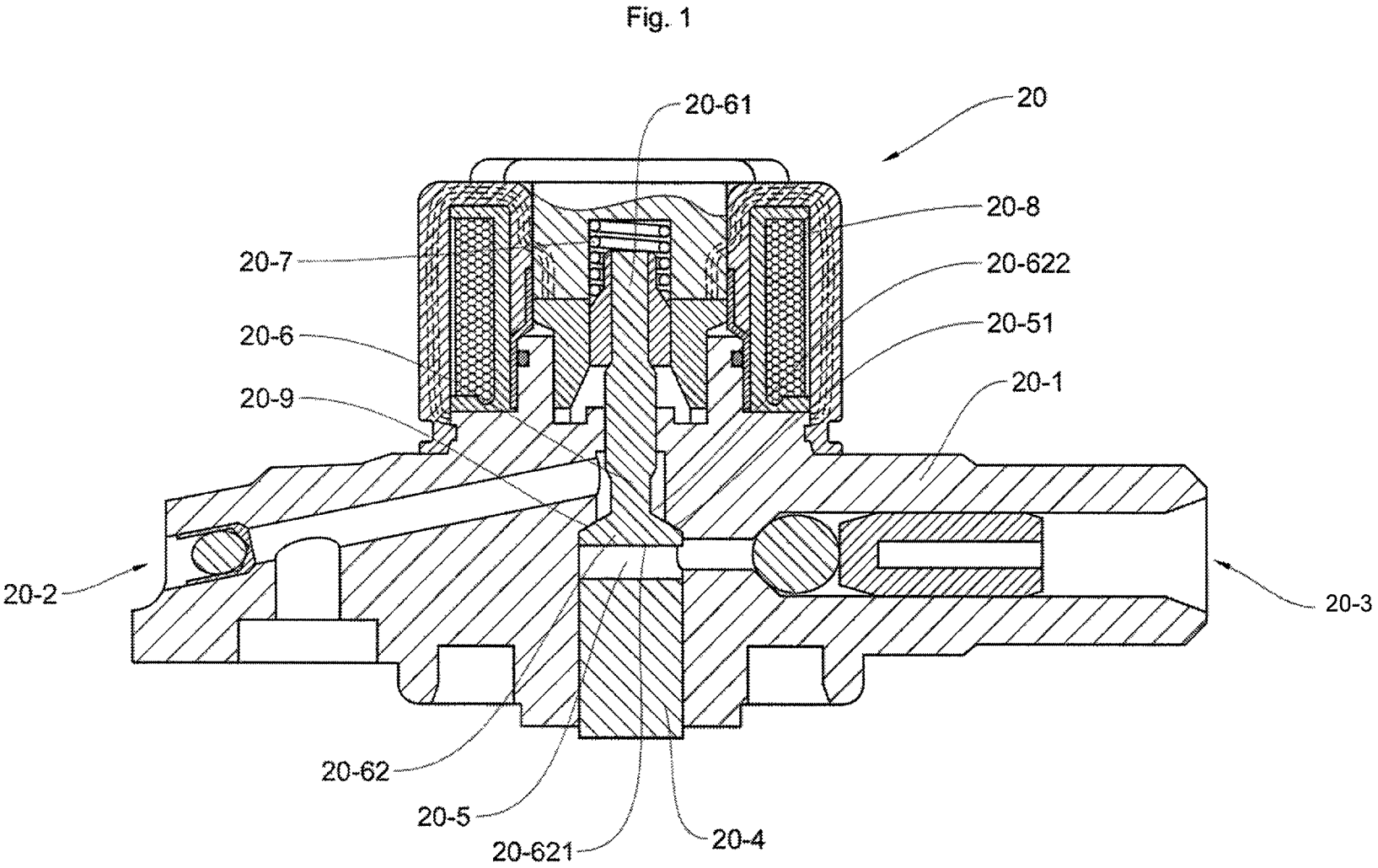
FIG. 1 is a simplified diagram of a digital high-pressure pump.

The method of an aspect of the present invention will be presented here in the case of controlling a high-pressure pump installed in a motor vehicle. FIG. 1 illustrates, in a simplified manner, a high-pressure pump 20 designed to supply highly pressurized fuel to a common rail of an internal combustion engine of the motor vehicle. The fuel may be for example diesel, and the pressure delivered by the high-pressure pump 20 may be of the order of 1000 bar. This pressure value as well as the type of fuel are given by way of example and are in no way limiting with regard to the scope of an aspect of the invention.

The high-pressure pump 20 includes a pump body 20_1, a low-pressure input 20_2, a high-pressure output 20_3, a piston 20_4 designed to move in a chamber 20_5 in order to raise the pressure of the fuel and a valve 20_6.

The valve 20_6 includes a valve rod 20_61 and a valve head 2062. The valve head 20_62 has an upper valve head portion 20_621 and a lower valve head portion 20_622; the upper valve head portion 20_621 facing the piston 20_4.

The chamber 20_5 has a chamber stop 20_51 of a shape designed to receive the lower valve head portion 20_622, making it possible to maintain the pressure of the fuel in the common rail.

A spring 20_7 is positioned around the valve rod 20_61 in order to keep the valve 20_6 in a first position. The valve 20_6 is therefore designed to move between the first position and a second position, as shown in FIG. 1. The first position of the valve 20_6 allows the fuel coming from the low-pressure input 20_2 to pass in order to fill the chamber 20_5. The second position allows the valve head 20_62 to be in contact with the cylinder stop 20_51 in order to raise the pressure of the fuel at the high-pressure output 20_3.

The high-pressure pump 20 is activated, inter alia, using an electromagnet 20_8 which, in response to an electrical control signal, moves the valve 20_6 from the first position to the second position. As the operation of the high-pressure pump 20 is well known to those skilled in the art, it will not be explained in more detail here. Of course, the high-pressure pump 20 described and illustrated in FIG. 1 is given by way of example, and another high-pressure pump may also be used. Furthermore, the high-pressure pump 20 presented here is a digital high-pressure pump and is controlled by the electrical control signal, which is a pick and hold signal.

Setting mechanical components in motion sometimes causes the generation of particles that may cause a malfunction of the high-pressure pump 20. To illustrate such a phenomenon, FIG. 1 shows a particle 20_9, which is for example of a metal nature. In the example of FIG. 1, the particle 20_9 is lodged at an interface between the valve head 20_62 and the chamber stop 20_51, preventing complete closure thereof and therefore causing incorrect operation of the high-pressure pump 20. The particle 20_9 has for example a size of the order of a micrometer. Of course, there may be a plurality of particles 20_9.

An aspect of the present invention proposes a method for controlling the high-pressure pump 20 that is designed to move the pump 20_6 in order to eliminate the particle 20_9. The method of an aspect of the invention is preferably intended to control a digital high-pressure pump.

Figure 2:
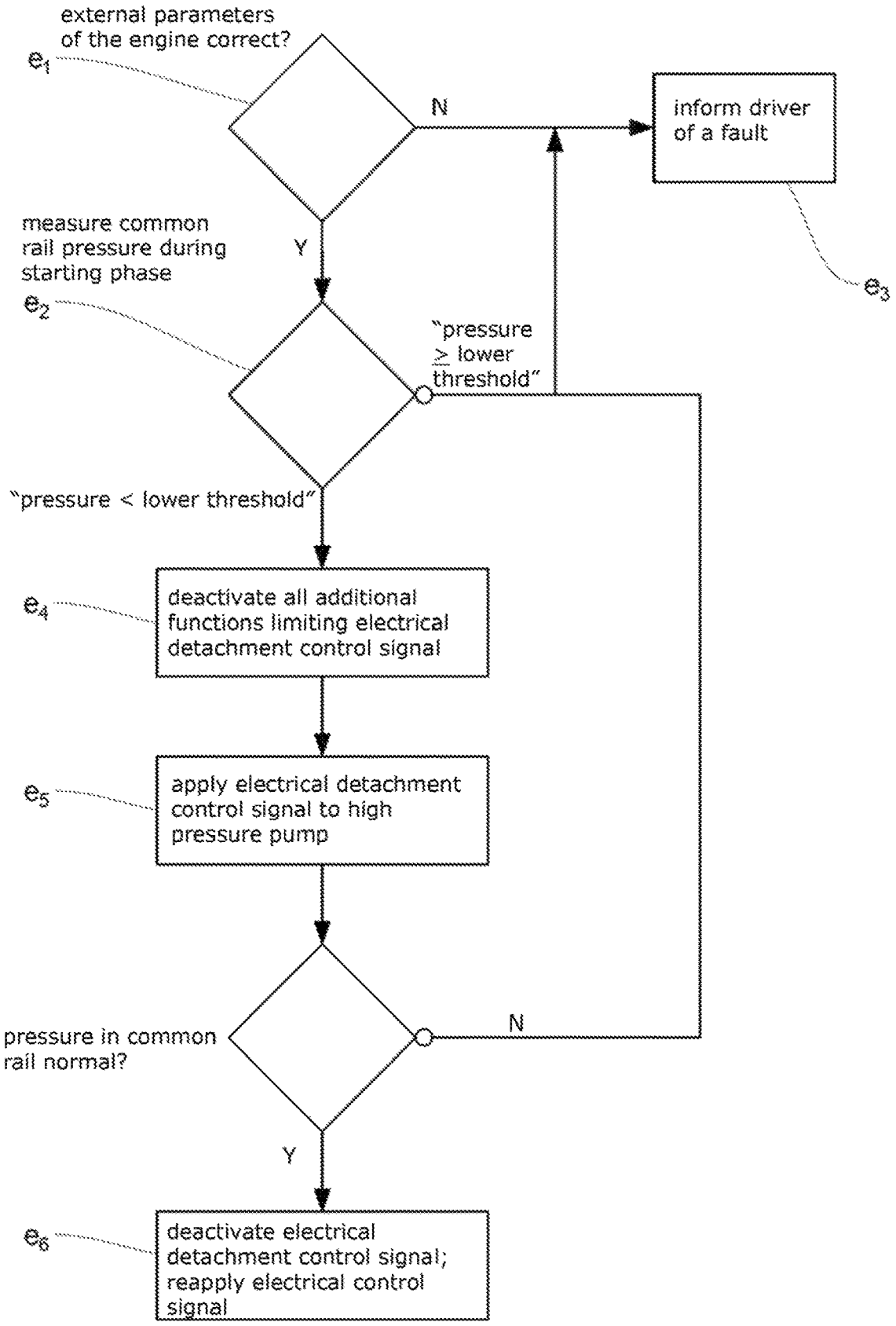
FIG. 2 is a flowchart of the method of an aspect of the invention for controlling the digital high-pressure pump shown in FIG. 1, and FIGS. 3 and 4 are an example of a control signal used by the method of an aspect of the invention.
Figure 3:
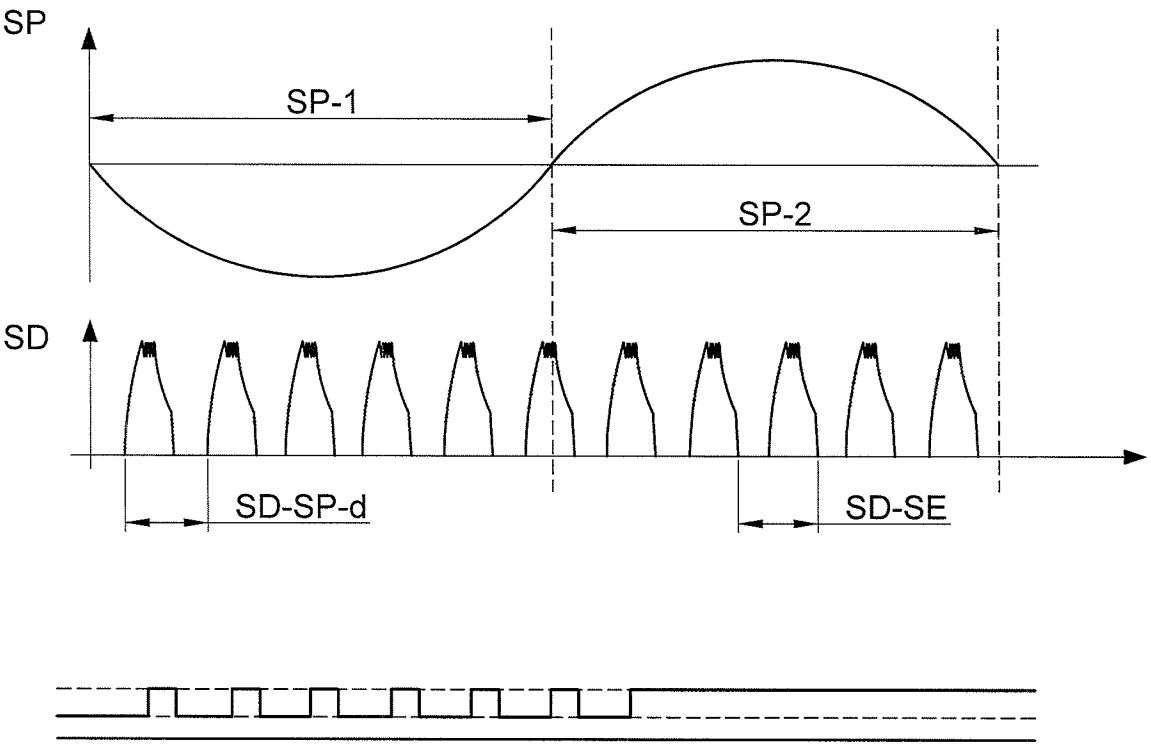
Figure 4:
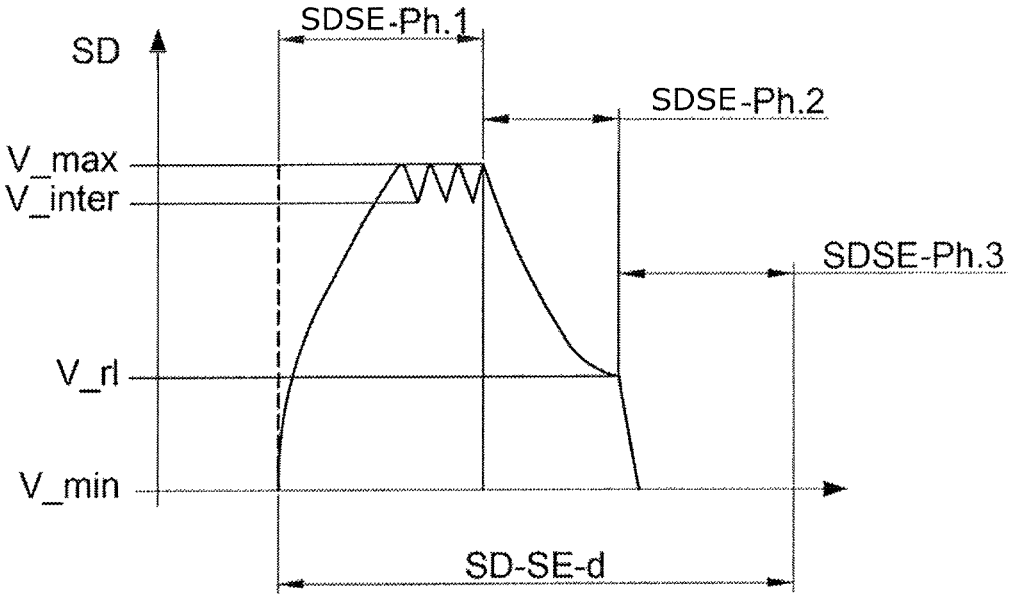

FIG. 2 shows a flowchart of the various steps of the method for controlling the high-pressure pump 20 according to an aspect of the invention. FIG. 3 and FIG. 4 furthermore also show an exemplary profile of an electrical detachment control signal, called SD, used by the method of an aspect of the invention.

The method of an aspect of the invention is preferably used or activated during a starting procedure of the internal combustion engine, and more particularly when said internal combustion engine is not starting. Expediently, the method of an aspect of the invention is launched or activated only after checking the cause of non-starting of the internal combustion engine.

To this end, the method of an aspect of the invention includes a first step e1 in which external parameters of the internal combustion engine are tested in order to ensure that the non-starting of the internal combustion engine is probably linked to incorrect operation of the high-pressure pump 20. It is thus first of all tested for example whether there is enough fuel in the tank to ensure starting of the internal combustion engine.

As a variant, the correct operation of control electronics of the high-pressure pump 20 may also be tested during this first step e1.

Again in an additional variant, the energy level of a battery of said motor vehicle may also be tested.

The method of an aspect of the invention makes provision to move to a second step e2 if the external parameters of the internal combustion engine are correct, and it is therefore almost certain that the non-starting of the internal combustion engine is linked to a fault with the high-pressure pump 20, and more particularly to the presence of at least one particle 20_9 therein.

If at least one of the external parameters of the internal combustion engine is incorrect, then the method of an aspect of the invention moves to a third step e3.

The third step e3 consists in informing the driver of the motor vehicle about a fault requiring intervention by a person trained to intervene on the motor vehicle. The information may be conveyed by turning on an indicator light on the dashboard.

Expediently, to confirm the diagnosis made in the first step e1, the method of an aspect of the invention makes provision, in the second step e2, to measure the pressure in the common rail during the starting phase. It is thus possible to check that the pressure in the common rail is less than a lower threshold value, for example 1000 bar.

If the value of the pressure that is measured is less than the lower pressure threshold value, then the cause of non-starting of the internal combustion engine is very probably linked to the presence of the particle 20_9 in the high-pressure pump 20. In this case, it is proposed to move to a fourth step e4.

In the opposite case, that is to say if the pressure in the common rail during the starting phase is greater than or equal to the lower threshold pressure, then the cause of non-starting of the internal combustion engine is probably not, according to the method of an aspect of the invention, linked to the presence of a particle 20_9 in said high-pressure pump 20. In this case, the method makes provision to move to the third step e3.

The fourth step e4 consists in deactivating all of the additional functions limiting the electrical detachment control signal SD electrically and/or in terms of time, by replacing the electrical control signal initially applied to the high-pressure pump 20. Thus, for example, if the high-pressure pump 20 has a noise-limiting function, then this is deactivated.

As a variant, if the high-pressure pump 20 has functions for limiting the current or the power of the electrical control signal, then these are also deactivated. Thus, expediently, by virtue of deactivating these functions, it is possible to utilize all of the electric power and/or energy available for the electrical detachment control signal in order to try to eliminate the particle 20_9.

Once the additional functions have been deactivated, the method of an aspect of the invention moves to a fifth step e5. The fifth step e5 consists in applying the electrical detachment control signal, called SD, as shown in FIG. 3, to the high-pressure pump 20 using for example its control electronics.

FIG. 3 also shows another signal representative of the state of the high-pressure pump 20; this signal is called SP in FIG. 3.

During a first phase called SP_1 in FIG. 3, the high-pressure pump 20 is in a pumping mode; that is to say that the fuel coming from the low-pressure pump arrives via the low-pressure input 20_2 and fills the chamber 20_5.

During a second phase called SP_2, the fuel is firstly pressurized by the rising of the piston 20_5 and the closure of the valve 20_6, and is secondly delivered to the common rail.

Advantageously, the application of the electrical detachment control signal SD coupled with the rising of the cylinder 20_5 and with the descent of said cylinder 20_5 increases the displacement force of the valve 20_6 and thus makes it possible to improve the efficiency of the method of an aspect of the invention.

The electrical detachment control signal SD may be divided into a repetition of an elementary signal SD_SE as illustrated in FIG. 4.

In one exemplary embodiment of the method of an aspect of the invention, the elementary signal SD_SE is a pick and hold signal. For example, the elementary signal SD_SE has a duration SD_SE_d of 10 ms. The duration SD_SE_d is selected depending on the characteristics of the high-pressure pump 20 and of the control electronics of the high-pressure pump 20.

To facilitate the depiction of the various portions of the elementary signal SD_SE, said elementary signal is shown in FIG. 4. The elementary signal SD_SE has a first elementary signal phase SD_SE_Ph_1, a second elementary signal phase SD_SE_Ph_2, and lastly a third elementary signal phase SD_SE_Ph_3.

The first elementary signal phase SD_SE_Ph_1 has a duration SD_SE_Ph_1_*d* that is determined and able to be modified depending on the type of high-pressure pump 20 to be controlled. The duration SD_SE_Ph_1_*d* is determined such that the elementary signal SD_SE moves from a first minimum value V_min to a first maximum value V_max.

The duration SD_SE_Ph_1_*d* has for example a value of 5 ms. The first minimum value V_min is for example 0 A and the first maximum value V_max is for example 100 mA. Depending on the control electronics, the first maximum value V_max may oscillate between the first maximum value V_max and a first intermediate value V_inter, V_inter being less than V_max but greater than V_min. These oscillations between the first maximum value V_max and the first intermediate value V_inter are linked to the control electronics. Advantageously, the oscillations between the first maximum value V_max and the first intermediate value V_inter do not modify, or only very slightly modify, the position of the valve 20_6 against the cylinder stop 20_51.

The second elementary signal phase SD_SE_Ph_2 has a duration SD_SE_Ph_2_*d* that makes it possible to create a freewheeling phase in the control circuit of the high-pressure pump 20. Those skilled in the art are well aware of the benefit and the effect of a freewheeling phase; these will therefore not be presented in more detail here. Thus, during the second elementary signal phase SD_SE_Ph_2, said signal moves from the first maximum value V_max to a first freewheeling value V_rl. In one exemplary embodiment, the first freewheeling value V_rl is less than the first intermediate value V_inter. In one exemplary embodiment, the duration SD_SE_Ph_2_*d* is 3 ms.

The third elementary signal phase SD_SE_Ph_3 has a duration SD_SE_Ph_3_*d* that is also able to be modified. For example, SD_SE_Ph_3_*d* has a duration of 2 ms. Furthermore, during the third elementary signal phase SD_SE_Ph_3, the elementary signal moves from the first freewheeling value V_rl to the first minimum value V_min.

As mentioned further above in the description, the elementary signal SD_SE is repeated n times and forms the electrical detachment control signal SD. Advantageously, the method of an aspect of the invention proposes to apply the electrical detachment control signal SD during the first phase SP_1 of the pump state signal SP and also during the second phase SP_2 of said same signal. In one exemplary embodiment of the method of an aspect of the invention, the elementary signal SD_SE is applied at least once to the high-pressure pump 20 during the first phase SP_1 and at least once during the second phase SP_2.

In the exemplary embodiment illustrated in FIG. 3, the elementary signal SD_SE is applied 5 times during the first phase SP_1 and the elementary signal SD_SE is applied 5 times during the second phase SP_2.

Advantageously, by virtue of the method of an aspect of the invention, the valve 20_6 is actuated during the first phase SP_1, that is to say set in motion in the cylinder 20_5, the same number of times as the electrical detachment control signal SD_SE is applied. The valve thus moves from the first position to the second position at least five times, thereby making it possible to shift and possibly dislodge the particle 20_9 positioned on the valve head 20_61.

Advantageously, during the second phase SP_2, the valve 20_6 also has the elementary signal SD_SE applied to it 5 times, thereby making it possible to improve the contact at the interface between the valve head and the base of the cylinder, making it possible to eliminate the particle 20_9.

Thus, by virtue of the method of an aspect of the invention and of the application of the electrical detachment control signal SD to the high-pressure pump 20, it is possible to remove at least one particle 20_9 positioned on the interface between its valve head and the base of the cylinder.

The method of an aspect of the invention proposes, during the second phase SP_2, to control the pressure in the common rail and to observe whether this reaches and exceeds the minimum pressure value, for example 1000 bar, which is synonymous with correct closure of the valve 20_6 against the cylinder stop 20_5, and therefore with correct operation of the high-pressure pump 20, and therefore to eliminate the particle 20_9.

In one exemplary embodiment of the method of an aspect of the invention, it is proposed, during a sixth step e6, when the pressure in the common rail is normal again, to deactivate the application of the electrical detachment control signal SD to the high-pressure pump 20 and to reapply the electrical control signal used when the high-pressure pump 20 is in a normal operating state.

The method of an aspect of the invention furthermore makes provision, when, despite the electrical detachment control signal being applied during the starting phase, the engine does not start, to move to the third step e3.

As a variant, the electrical detachment control signal SD is applied throughout the entire starting phase, for as long as the pressure in the common rail is less than the minimum pressure value.

The method of an aspect of the invention may be implemented in an engine control computer for example. The amplitude and period values are given purely by way of illustration and are in no way limiting with regard to the scope of an aspect of the invention.

Of course, aspects of the present invention are not limited to the preferred embodiment described above and illustrated in the drawing and to the variant embodiments mentioned, but extends to all variants within the competence of those skilled in the art.

The invention claimed is:

1. A method for controlling a digital high-pressure pump controlled by a peak and hold control signal, including a low-pressure input designed to receive a fuel, a high-pressure output designed to deliver pressurized fuel, at least one chamber designed to receive a piston, the piston being able to move and allowing the fuel in the high-pressure pump to be pressurized toward its high-pressure output, a valve including a valve head, the valve being designed to move from a first position to a second position, the second position making it possible to keep the fuel pressurized in order to be delivered into a common rail through its high-pressure output, the high-pressure pump being activated inter alia during a starting procedure of an internal combustion engine, the control method including the following consecutive steps when the internal combustion engine does not manage to start during the starting procedure:

checking external parameters of the internal combustion engine, and then whether at least one external parameter is validated;

measuring a physical parameter at the high-pressure output, applying an electrical detachment control signal as a replacement for the electrical control signal to the high-pressure pump during the starting procedure when the physical parameter measured at the high-pressure output is less than or equal to a reference value, and stopping the starting procedure after a given time when the physical parameter measured at the high-pressure output is greater than the reference value.

2. The method for controlling a high-pressure pump as claimed in claim 1, wherein the checking of the external parameters of the internal combustion engine includes a check of the fuel level in a tank.

3. The method for controlling a high-pressure pump as claimed in claim 1, wherein the checking of the external parameters of the internal combustion engine includes a check of a controller of the high-pressure pump.

4. The method for controlling a high-pressure pump as claimed in claim 1, wherein the electrical detachment control signal is formed of an elementary electrical signal that is duplicated n times.

5. The method for controlling a high-pressure pump as claimed in claim 4, wherein the elementary electrical signal includes a first elementary phase, a second elementary phase and lastly a third elementary phase, the first elementary phase varying between a first minimum amplitude value and a first maximum amplitude value, the second elementary phase varying between the first maximum value and a freewheeling value, the third elementary phase varying between the first freewheeling value and the first minimum amplitude value.

6. The method for controlling a high-pressure pump as claimed in claim 4, wherein the electrical detachment control signal is applied to the high-pressure pump during at least one fuel intake phase.

7. The method for controlling a high-pressure pump as claimed in claim 4, wherein the electrical detachment control signal is applied to the high-pressure pump during at least one fuel delivery phase.

8. The method for controlling a high-pressure pump as claimed in claim 4, wherein the elementary electrical signal has a modifiable duration.

9. The method for controlling a high-pressure pump as claimed in claim 8, wherein the duration has a value of 10 ms.

10. The method for controlling a high-pressure pump as claimed claim 1, wherein the elementary electrical signal is a peak and hold signal.

11. The method for controlling a high-pressure pump as claimed in claim 2, wherein the checking of the external parameters of the internal combustion engine includes a check of a controller of the high-pressure pump.

12. The method for controlling a high-pressure pump as claimed in claim 5, wherein the electrical detachment control signal is applied to the high-pressure pump during at least one fuel intake phase.

* * * * *